US006250284B1

(12) United States Patent
Lamp

(10) Patent No.: US 6,250,284 B1
(45) Date of Patent: Jun. 26, 2001

(54) ENGINE WITH FUEL DELIVERY SYSTEM

(76) Inventor: Justin Lamp, 240B-B New Dr., Winston-Salem, NC (US) 27103

( * ) Notice: Subject to any disclaimer, the term of this patent is extended or adjusted under 35 U.S.C. 154(b) by 0 days.

(21) Appl. No.: 09/199,262

(22) Filed: Nov. 25, 1998

Related U.S. Application Data

(63) Continuation-in-part of application No. 09/080,731, filed on May 18, 1998, now Pat. No. 5,875,747, which is a continuation-in-part of application No. 08/824,471, filed on Mar. 26, 1997, now abandoned.

(51) Int. Cl.[7] ..... F02M 7/00; F02M 51/00
(52) U.S. Cl. ..... 123/445; 123/472; 261/DIG. 23
(58) Field of Search ..... 123/445, 472; 261/DIG. 23

(56) References Cited

U.S. PATENT DOCUMENTS 1,484,577 * 2/1924 Skaer ..... 261/DIG. 23
1,548,674 * 8/1925 Fredricksen ..... 261/DIG. 23
4,237,836 * 12/1980 Tanasawa et al. ..... 261/DIG. 23
4,243,003 * 1/1981 Knapp ..... 123/445
4,245,589 * 1/1981 Ryan ..... 123/445
4,250,842 * 2/1981 Sutton ..... 123/472
4,342,443 * 8/1982 Wakeman ..... 123/472
4,343,279 * 8/1982 Blaser ..... 123/445
4,354,470 * 10/1982 Miyaki et al. ..... 123/472
4,361,126 * 11/1982 Knapp et al. ..... 123/472
4,465,050 * 8/1984 Igashira et al. ..... 123/472
5,398,654 * 3/1995 Niebrzydoski ..... 123/445
5,533,480 * 7/1996 Jenkins ..... 123/472
5,924,408 * 7/1999 Van Der Wildenberg ..... 123/445

* cited by examiner

*Primary Examiner*—Thomas N. Moulis
(74) *Attorney, Agent, or Firm*—Kilpatrick Stockton LLP

(57) ABSTRACT

An engine employing magnetically actuated valves. The engine includes a combustion chamber, a port, an electromagnet, a valve, a biasing spring, and a valve guide. The valve is operably positioned in relation to the combustion chamber to allow fuel into the chamber and is actuated by a magnetic field to move within the valve guide. The engine also includes a fuel dispensing system including a tube having an aperture. The valve moves between a first and second position, alternating between obstructing and not obstructing the aperture, thereby blocking and allowing fuel flow throw the aperture.

8 Claims, 18 Drawing Sheets

ENGINE WITH FUEL DELIVERY SYSTEM

This is a continuation-in-part application of pending application Ser. No. 09/080,731 filed May 18, 1998, now U.S. Pat. No. 5,875,747 which is a continuation-in-part of application Ser. No. 08/824,471 filed Mar. 26, 1997 now abandoned, both of which are incorporated herein in full by reference.

FIELD OF THE INVENTION

The invention relates generally to a combustion engine, and pertains more specifically to an engine employing magnetically actuated valves and a valve-employing fuel-delivery system.

BACKGROUND OF THE INVENTION

The operation of a standard internal combustion engine is well known. A mechanically operated valve opens to allow an air and fuel mixture to enter the combustion chamber of an engine's cylinder. A spark within the cylinder ignites the air and fuel mixture, which causes the engine's piston to move. The moving piston provides torque, or turning force, to a crankshaft. The turning force of the crankshaft provides mechanical power for use in the chosen application, such as causing an automobile's wheels to turn or causing the cutting blade of a lawnmower to turn. After the air and fuel mixture is ignited, another mechanically operated valve is opened, allowing the burned gases, or exhaust, to escape out of the cylinder.

As mentioned, the valves in the combustion engines of today are mechanically actuated. Typically, a push rod and rocker arm combination, in conjunction with a spring biasing the valve, is used to open and close a valve in a combustion engine. The push rod and rocker-arm experience wear during use and sometimes have to be replaced.

Moreover, the push rod and rocker-arm combination causes some parasitic power loss. For example, the movement of the push rod and rocker-arm combination is actuated by the camshaft and thusly interacts with valves. Spring loaded valves place a very large load upon the camshaft, which is turned by a crankshaft. This operation may take 30–40% of an engine's power. Moreover, friction between parts within that combination is created during the movement of the combination and thus energy is used in overcoming that friction instead of directly used in the movement of a valve.

In addition, the push rod and rocker-arm combination takes up space in the engine and has some weight. Thus, the weight of the combination adds to the weight which the engine must drive, thereby increasing the force required of the engine. Moreover, the push rod and rocker-arm combination requires lubrication.

Thus, the currently-used system, embodied by a push rod and rocker-arm combination, that is presently used to open and close engine valves has several disadvantages.

The objective of the present invention is to provide a means for opening and closing the valves of a combustion engine that reduces or eliminates the disadvantages of the present system. The objective of the present invention is to provide a means for opening and closing the valves of a cylinder of a combustion engine that (1) reduces parasitic power loss caused by the movement of the currently-used system; (2) reduces the weight of an engine, thus allowing for increased fuel efficiency or increased power of an engine; (3) is easier than the currently-used system to maintain; (4) is versatile in that it can be used in a variety of engine types and sizes; (5) increases design possibilities by lessening the space taken up by means to operate engine valves; (6) is relatively easy to construct; (7) can provide valves that are substantially removed from the combustion area of the engine during the combustion phase of the engine; (8) can provide needs that are not substantially blocked by valves during the injection/exhaust phase of operation; and (9) can provide an engine that needs fewer parts than conventional engines and that incurs less wear on the engine parts. The construction of the present invention requires fewer parts than today's engines and is consequently less expensive than the construction of today's engines. Moreover, the use of magnetically actuated valves as described above allows the reduction of hydrocarbon emissions because the present invention lessens the contamination of the inlet charge and allows a higher compression ratio. Other advantages of the present invention will be apparent to those of ordinary skill in the art of the present invention.

SUMMARY OF THE INVENTION

The invention is an engine employing magnetically actuated valves. One embodiment of the engine includes a combustion chamber, a spark plug positioned to create a spark within the combustion chamber, a piston positioned within the combustion chamber, a crankshaft, a connecting rod, the connecting rod connecting the piston with the crankshaft, a fuel intake valve, and an exhaust valve. The fuel intake valve is operably positioned in relation to the combustion chamber to allow fuel into the combustion chamber. The fuel intake valve is actuated by a magnetic field. The exhaust valve is operably positioned in relation to the combustion chamber to allow exhaust to exit the combustion chamber. The exhaust valve is actuated by a second magnetic field.

In one embodiment, the engine comprises a combustion chamber, a port coupled to the combustion chamber, a valve guide adjacent to the port and coupled to the port, and a valve adapted to move within the valve guide and within the port. The valve is capable of movement within the valve guide such that the valve resides at least partially outside of the port. The valve is also capable of movement within the valve guide such that the valve resides at least partially outside of the combustion chamber.

In another embodiment, the engine may also include a tube having an aperture wherein the valve is capable of blocking the aperture, and the valve is capable of movement within the valve guide such that the aperture is at least partially unblocked.

In another embodiment, a valve system comprises a valve guide adapted to couple to the port, and a valve adapted to move within the valve guide and within the port. The valve is capable of movement within the valve guide such that the valve resides at least partially outside of the port and at least partially outside of the combustion chamber. The valve system may further comprise a tube having an aperture wherein the valve is capable of blocking the aperture. The valve is capable of movement within the valve guide such that the aperture is at least partially unblocked.

In another embodiment, a fuel-dispensing system includes a tube having an aperture and a valve capable of blocking the aperture. The valve is capable of movement such that the aperture is at least partially unblocked. The tube resides within the valve guide. A fuel delivery system, such as a fuel pump delivery system, is connected to the tube. Fuel is delivered through the aperture.

Another embodiment includes a fuel dispensing system comprising a tube having an aperture and a movable valve. The movable valve is capable of movement between at least a first position wherein the aperture is open and a second position wherein the aperture is closed by the valve. The movement of the valve and placement of the aperture regulates fuel delivery.

DETAILED DESCRIPTION

Figure 1:
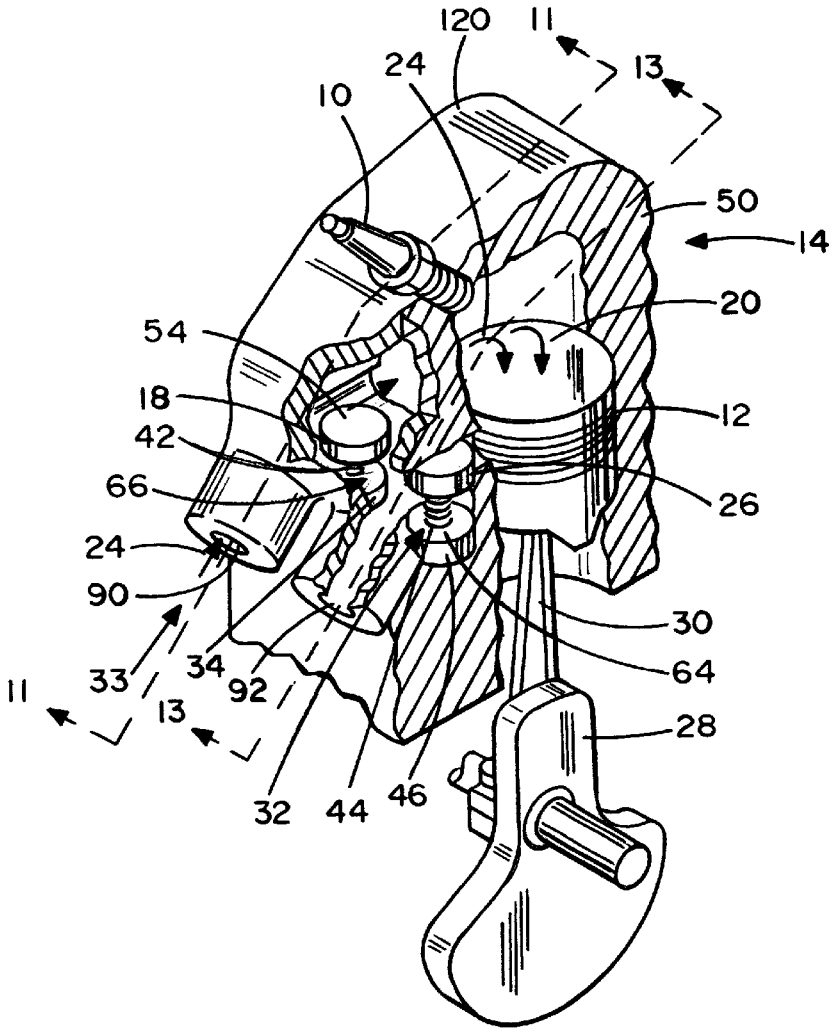
FIG. 1 shows a partial cut-away perspective view of a four-stroke engine of the present invention using magnetically actuated valves in its intake stroke.

FIG. 1 shows an embodiment of the present invention as a four-stroke, internal combustion engine using magnetically actuated valves. FIG. 1 shows a four-stroke, four-cycle engine 14. The engine 14 of FIG. 1 operates, with the exception of the valve operation, similarly to a standard four-stroke engine. The operation of a standard four-stroke engine is well known. Four events, or strokes, occur in order for the engine 14 of FIG. 1 to operate. Its operation takes place in two revolutions of the crankshaft 28. The four strokes that occur in the operation of the engine 14 are the intake stroke, shown in FIG. 1, the compression stroke, shown in FIG. 2, the power stroke, shown in FIG. 3, and the exhaust stroke, shown in FIG. 4.

Referring to FIG. 1, the intake stroke occurs when the piston 12 is traveling downward and creates a vacuum 50 within the cylinder 20. The cylinder is a combustion chamber. When the piston 12 begins to travel downward, a fuel intake valve magnet 34 emits an electromagnetic field (not shown). The magnets 34, 46 shown are stationary and are fixed by physical connection to the surrounding engine block. The magnets 34, 46 are capable of emitting an magnetic force sufficient to overcome the spring force of the springs. The electromagnetic field causes the fuel intake valve 18 to move toward the magnet 34 against the fuel-valve biasing spring 42 that the valve 18 is biased against, consequently compressing the biasing spring 42. The spring may be made of steel, such as high silicon steel, or other spring-biasing material. The valve and magnet are coupled to the spring in the embodiment shown by direct, physical attachment in the embodiment shown. The spring may rest between the valve and magnet (or between the valve and engine block in some embodiments) without physical attachment or be physically attached to the valve, magnet, or both. The magnet 34, spring 42, valve 18, in addition to a fuel intake valve cylinder 66, comprise what is referred to as a fuel intake magnetic valve assembly 33. The movement of the fuel intake valve 42 toward the magnet 34 leaves a gap 54 in the intake port 90. A combustible material 24, in the embodiment shown a fuel and air mixture, is drawn into the cylinder 20 through the gap 54 left in the port 90 by the movement of the fuel intake valve 18.

Figure 18:
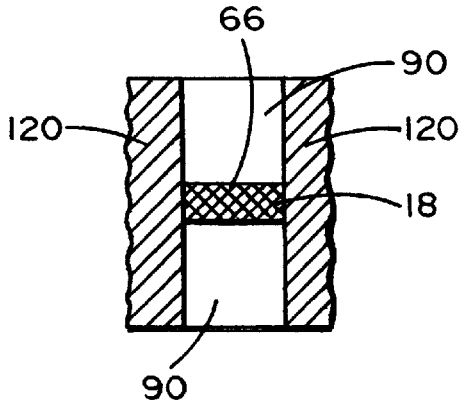
FIG. 18 shows a top cut-out view of an engine according to the present invention, showing a port, a valve, and the surrounding engine block.
Figure 19:
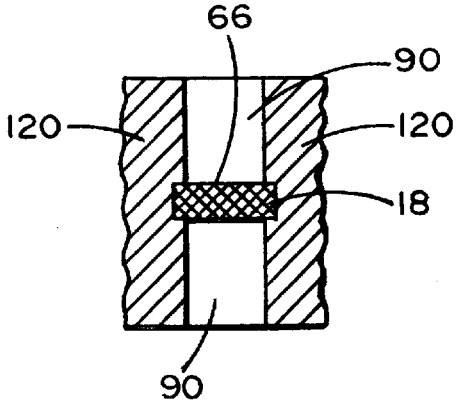
FIG. 19 shows a top cut-out view of an engine according to the present invention, showing a port, a valve, and the surrounding engine block.

The valve 18 shown is cylindrical, but it may be any convenient shape. For example, the valves shown in FIG. 18 and FIG. 19 are rectangular. The valve may be made of any material attracted to electromagnetic force, such as steel or cobalt. The fuel intake valve 18 reciprocates within the fuel intake valve cylinder 66. Likewise, the exhaust valve 26 reciprocates within the exhaust cylinder 64. The valve cylinder 66, 64 is one form of a valve guide. As shown, e.g., in FIG. 1 and FIG. 8, the fuel intake valve guide 66 is coupled to the fuel intake port 90, and the exhaust valve guide 64 is coupled to the exhaust port 92. The valve guides may take any shape, and generally conform to the shape of the valve which they guide.

Figure 8:
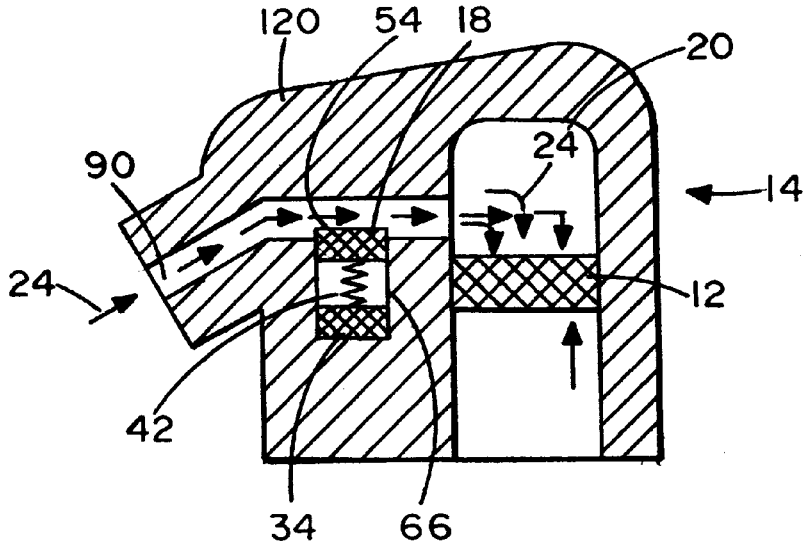
FIG. 8 shows a cut-out view of the engine shown in FIGS. 1–4 along the line 11—11 in the intake stroke, showing the intake valve assembly, intake port, and the gap in the intake port during the intake phase shown in FIG. 1.
Figure 9:
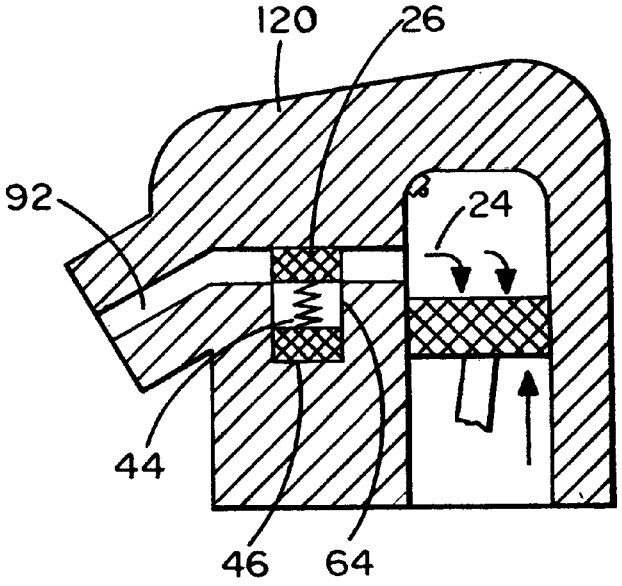
FIG. 9 shows a cut-out view of the engine shown in FIGS. 1–4 along the line 13—13 in the intake stroke, showing the exhaust valve assembly and exhaust port during the intake phase shown in FIG. 1.

The engine of FIG. 1 can be seen in a cut-out side view in FIG. 8 and FIG. 9. FIG. 8 shows the location of the intake valve 18 and the gap 54 in the intake port 90 and the intake valve guide 66 during this intake phase. FIG. 9 shows the location of the exhaust valve 26 in the exhaust port 92 and the exhaust valve guide 64 during this intake phase.

Note that when a valve 18, 26 blocks a port 90, 92, the valve 90, 92 is sufficiently close to the engine block 120, valve guide wall 66, 64, or shield (see below) that no, or insignificantly little, exhaust or intake material seeps into the valve guide 66, 64. Likewise, when a valve 18, 26 is lowered wholly or partially into the valve guide 66, 64 the valve is sufficiently close to the engine block 120, valve guide wall 66, 64, or shield that no, or insignificantly little, exhaust or intake material seeps into the valve guide 66, 64. Drainage structure, sealing structure, or other, similar devices could be used to combat seepage of intake or exhaust into the valve guide from the port.

Figure 2:
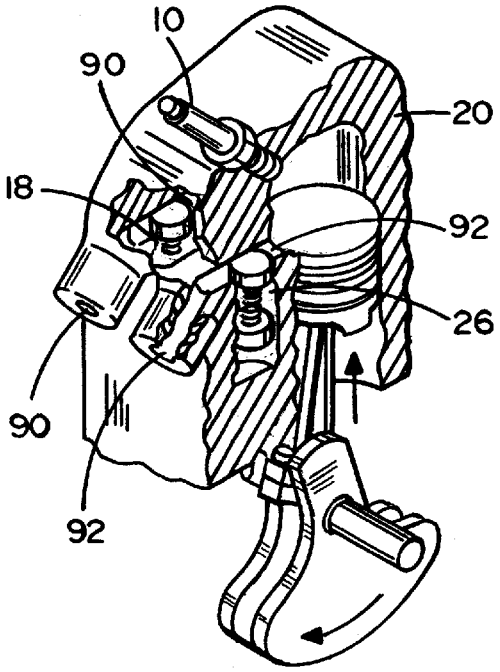
FIG. 2 shows a partial cut-away perspective view of a four-stroke engine of the present invention in its compression stroke.

Referring to FIG. 2, as the piston 12 begins to travel upward, the fuel intake valve magnet 34 ceases emitting an electromagnetic field. Consequently, the force of the fuel intake valve 18 no longer compresses the fuel-valve biasing spring 42, and the spring 42 forces the fuel intake valve 18 to move within the valve guide back into the intake port 90 to its normally-closed position. The fuel intake valve 18 thus moves upwards within the fuel intake valve guide such that it enters the fuel intake port 90, thereby blocking and closing the port 90. In this position, the valve 18 blocks any entry of air/fuel mixture 24 into the cylinder 20. Also, the closing of the valve 18 traps the fuel and air mixture 24 in the cylinder 20. The piston 12 travels upward and compresses the fuel and air mixture 24 in the cylinder 20. Thus, in this phase, both valves 18, 26 are in their normal position, blocking the ports 90, 92, and thereby closing the ports 90, 92.

Figure 10:
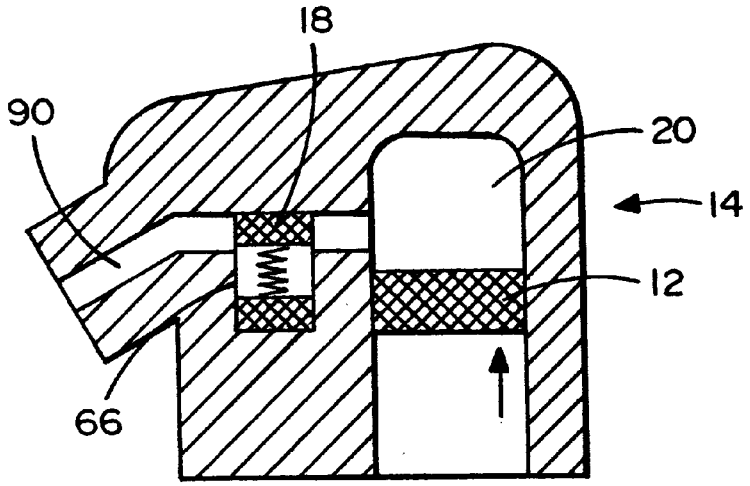
FIG. 10 shows a cut-out view of the engine shown in FIGS. 1–4 along the line 11—11 in the compression stroke, showing the intake valve assembly and intake port during the compression phase shown in FIG. 2.
Figure 11:
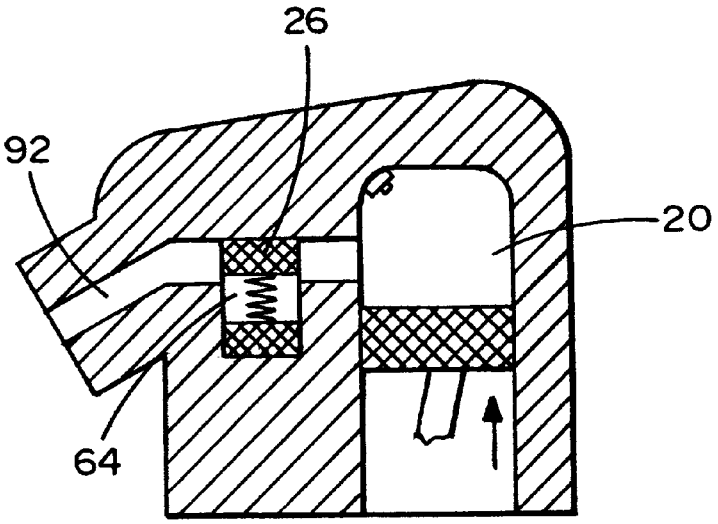
FIG. 11 shows a cut-out view of the engine shown in FIGS. 1–4 along the line 13—13 in the compression stroke, showing the exhaust valve assembly and exhaust port during the compression phase shown in FIG. 2.

The engine of FIG. 2 can be seen in a cut-out side view in FIG. 10 and FIG. 11. FIG. 10 shows the location of the intake valve 18 in the intake port 90 and the intake valve guide 66 during this compression phase. FIG. 11 shows the location of the exhaust valve 26 in the exhaust port 92 and the exhaust valve guide 64 during this compression phase.

Figure 3:
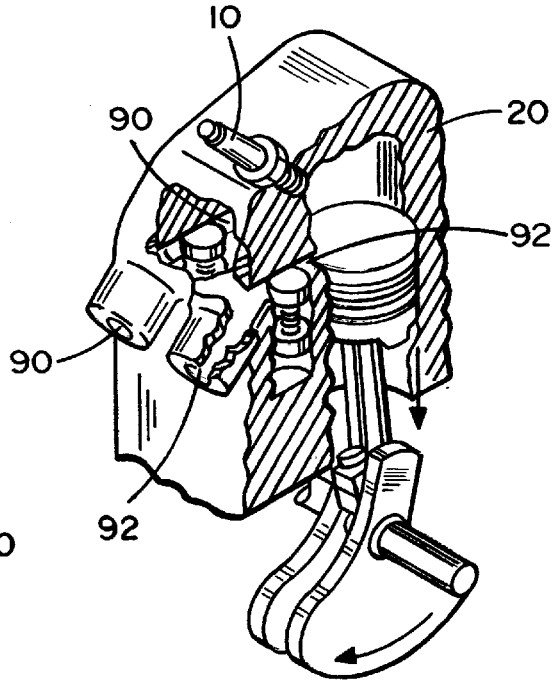
FIG. 3 shows a partial cut-away perspective view of a four-stroke engine of the present invention in its power stroke.

Referring to FIG. 3, when the piston 12 reaches the top of its stroke and starts back down the cylinder 20, the spark plug 10 provides a spark in the cylinder 20. This spark 52 (shown as wavey lines) ignites the air and fuel mixture 24, causing an explosion (not shown) in the cylinder 20. The explosion and rapid of the gases (not shown) within the cylinder 20 causes the piston 12 to proceed downward in the cylinder 20.

Figure 12:
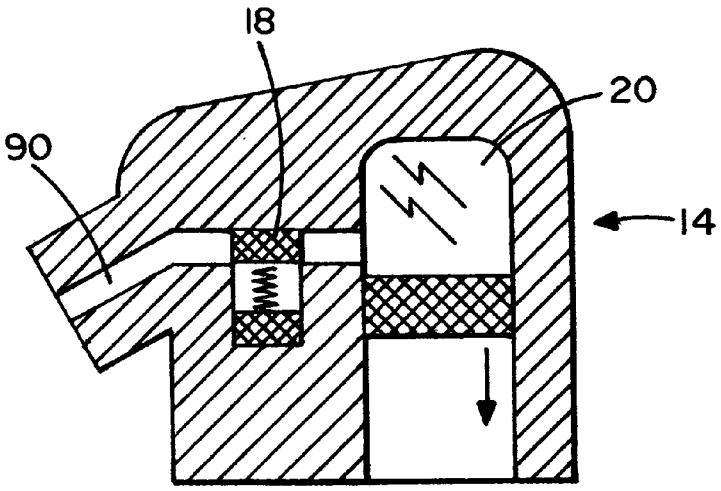
FIG. 12 shows a cut-out view of the engine shown in FIGS. 1–4 along the line 11—11 in the power stroke, showing the intake valve assembly and intake port during the power phase shown in FIG. 3.
Figure 13:
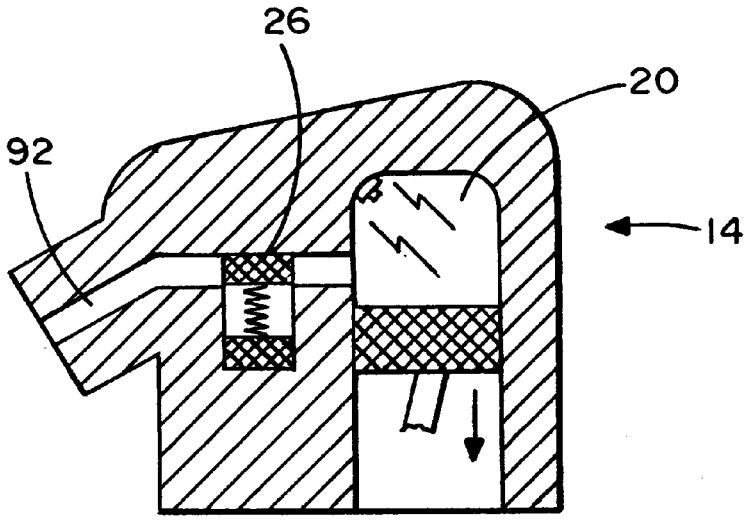
FIG. 13 shows a cut-out view of the engine shown in FIGS. 1–4 along the line 13—13 in the power stroke, showing the exhaust valve assembly and exhaust port during the power phase shown in FIG. 3.

The engine of FIG. 3 can be seen in a cut-out side view in FIG. 12 and FIG. 13. FIG. 12 shows the location of the intake valve 18 in the intake port 90 and the intake valve guide 66 during this power phase. FIG. 11 shows the location of the exhaust valve 26 in the exhaust port 92 and the exhaust valve guide 64 during this power phase.

Figure 4:
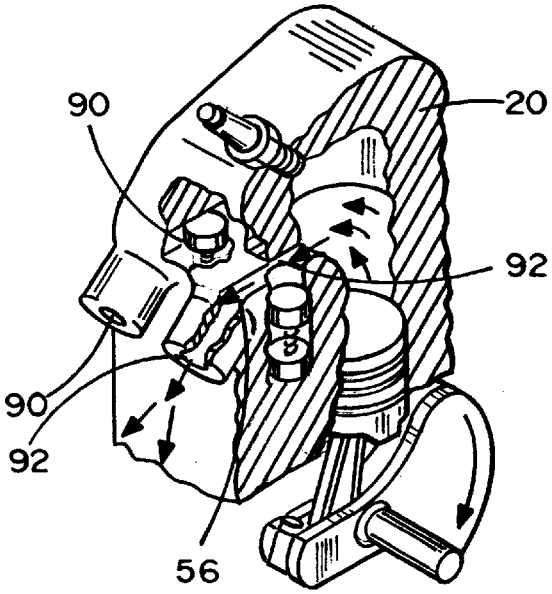
FIG. 4 shows a partial cut-away perspective view of a four-stroke engine of the present invention in its exhaust stroke.

Referring to FIG. 4, when the piston 12 reaches the end of its downward travel in the cylinder 20, an exhaust-valve magnet 46 emits an electromagnetic field (not shown). The electromagnetic field causes the exhaust valve 26 to move toward the magnet 46 against the exhaust-valve biasing spring 44 that the valve 26 is biased against, consequently compressing the biasing spring 44. The magnet 46, spring 44, valve 26, in addition to an exhaust valve cylinder 64, comprises what is referred to as an exhaust valve assembly 32. The movement of the exhaust valve 26 toward the magnet 46 leaves a gap 56 in the port 92. On the upcoming upward stroke of the piston 12, the piston 12 forces the burned gases or exhaust 60 out of the gap 56 in the port 92 caused by the opened valve 26.

Figure 14:
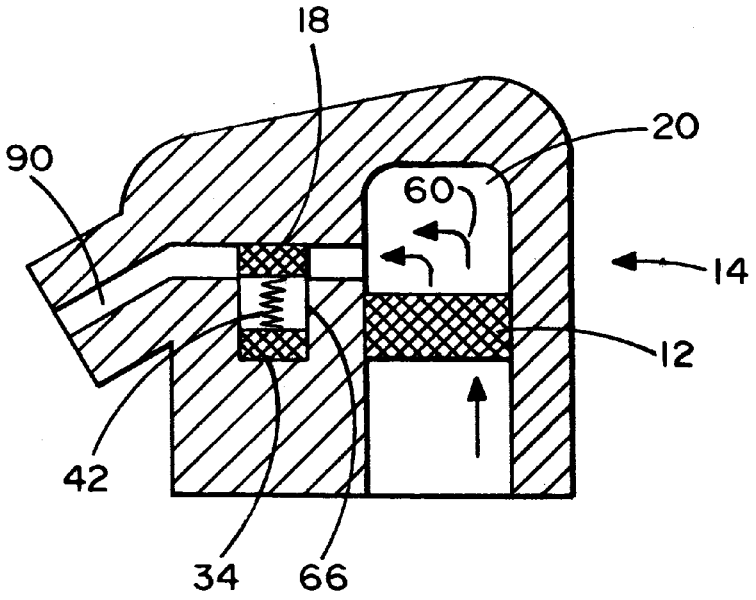
FIG. 14 shows a cut-out view of the engine shown in FIGS. 1–4 along the line 11—11 in the exhaust stroke, showing the intake valve assembly and intake port during the exhaust phase shown in FIG. 4.
Figure 15:
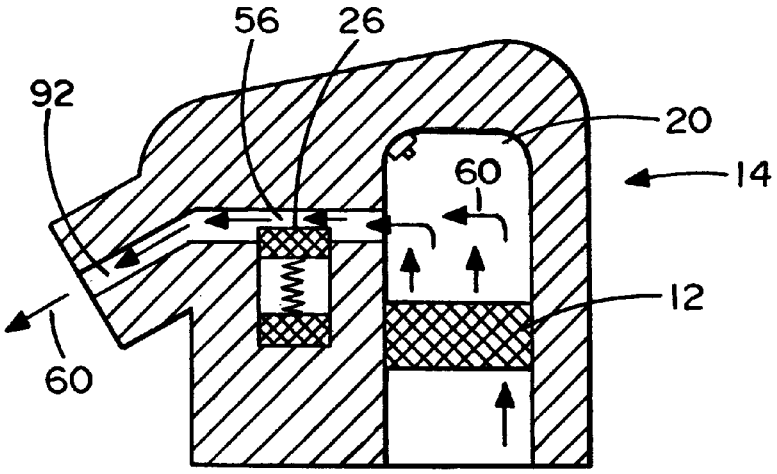
FIG. 15 shows a cut-out view of the engine shown in FIGS. 1–4 along the line 13—13 in the exhaust stroke, showing the exhaust valve assembly, exhaust port, and the gap in the exhaust port during the exhaust phase shown in FIG. 3.

The engine of FIG. 4 can be seen in a cut-out side view in FIG. 14 and FIG. 15. FIG. 14 shows the location of the intake valve 18 in the intake port 90 and the intake valve guide 66 during this exhaust phase. The intake port 90 is closed, blocked by the intake valve 18. FIG. 15 shows the location of the exhaust valve 26 and the gap in the exhaust port 92, and the exhaust valve guide 64 during this exhaust phase.

When the piston 12 reaches the top of cylinder 20, the exhaust magnet 46 ceases emitting an electromagnetic field. Consequently, the force of the exhaust valve 26 no longer compresses the exhaust biasing spring 44, and the spring 44 forces the exhaust valve 26 along the exhaust valve guide back into its normally-closed position, blocking the exhaust port 92. Immediately afterwards, the fuel intake valve 18 is opened as described above, and the piston 12 begins a downward stroke, and the four strokes described above begin again with the first stroke describe above.

Figure 23:
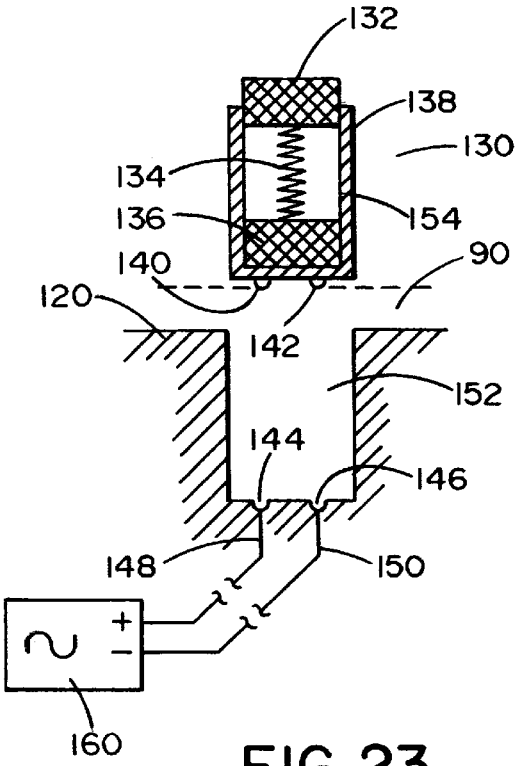
FIG. 23 shows a section view of part of an engine according to the present invention including a removable valve guide in the form of a magnetic shield, and a valve assembly, as well as electrical conductors and receptacles for supplying power to an electromagnet.

The intake electromagnet 34 and the exhaust electromagnet 46 can be energized by an ignition system (not shown) or other power source, to which the electromagnets of the engine are connected. For example, FIG. 23 shows an electromagnet connected to an AC power source 160. The electromagnet may alternatively be connected to a DC power source and the electromagnet may be of the type to use DC power to alternatively actuate and de-actuate its magnetic force at a predetermined rate. The ignition system can also be controlled by, for example, a crank trigger (not shown) or CPU (not shown), or some combination of the control and power means described. The electromagnet 34, 46 exerts sufficient electromagnetic force to overcome the valve spring 42, 44 pressure to "open" the valve in the shown embodiment. The present invention could be configured to provide a valve that is normally open, and that closes upon actuation of an electromagnet.

Figure 16:
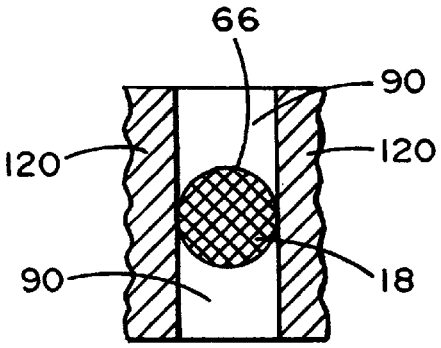
FIG. 16 shows a top cut-out view of an engine according to the present invention, showing a port, a valve, and the surrounding engine block.
Figure 17:
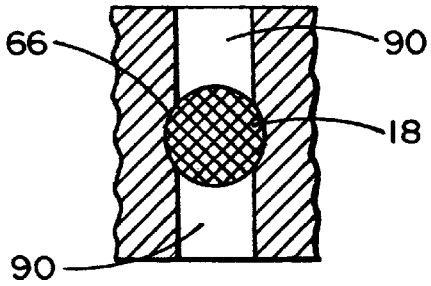
FIG. 17 shows a top cut-out view of an engine according to the present invention, showing a port, a valve, and the surrounding engine block.

As mentioned above, the valves 18, 36 may be of any selected shape. Referring to FIGS. 16–19, the valve guide 66 may be coupled to the port 90 in a number of configurations. The valve guide 66 may be cut to the dimensions of the port 90 as shown in FIGS. 16 and 18. Also, at the point of coupling, the valve guide 66 may be wider than the port 90 is through the rest of the port's length, as shown in FIGS. 17 and 19. Configurations such as that shown in FIGS. 17 and 19 allow the engine block to assist somewhat in resisting the forces upon the valve during the combustion phase of an engine's operation.

Note that in the embodiment shown, the force as a result of combustion is perpendicular to the springs. Thus, it is not necessary for the spring to be of such strength to withstand the direct force of the combustion.

Figure 5:
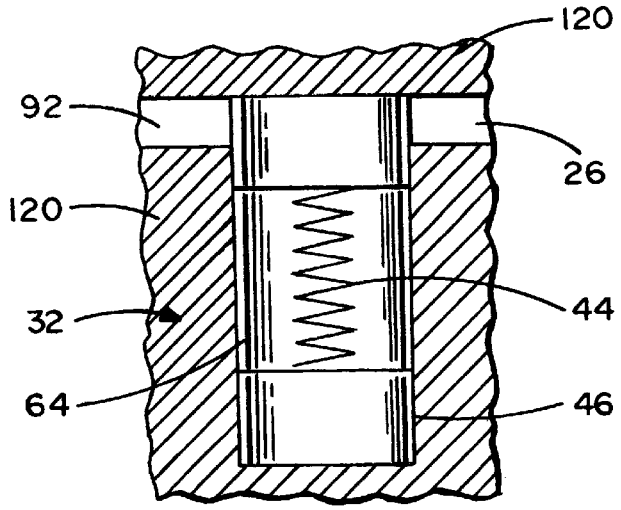
FIG. 5 shows a sectional view showing a full valve, spring, and magnet in a valve cylinder, the surrounding engine block in a cut-out view, and a port used in the present invention.

FIG. 5 shows a cut-out, close-up view of a magnetically actuated valve assembly used as the assembly for the fuel intake valve 18 or the exhaust valve 26 of the present invention as shown in FIGS. 1–4. The magnetically actuated valve assembly shown in FIG. 5 is the exhaust valve assembly 32 shown in FIGS. 1–4. The assembly 32 of FIGS. 1–5 comprises a magnet 46, a spring 44, an exhaust valve 26, and an exhaust valve cylinder 64. The fuel valve assembly 33 of FIGS. 1–4 similarly comprises a magnet 34, a spring 42, an fuel valve 18, and a fuel valve cylinder 66. The fuel valve cylinder 64, 66 shown comprises a cylindrical area cut into the engine block 120. The engine block may be made of steel, cast iron, high nickel cast iron, aluminum or aluminum alloys, or other material used to construct engine blocks.

Figure 6:
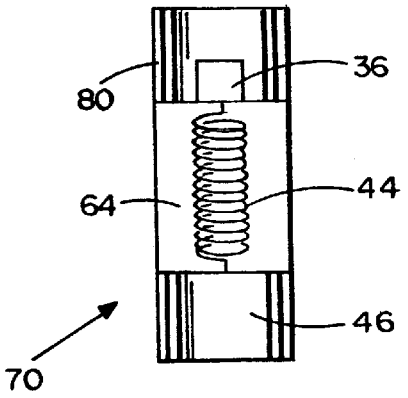
FIG. 6 shows a sectional view showing a full valve with a ferromagnetic insert, spring, and magnet in a valve cylinder, the surrounding engine block in a cut-out view, and a port used in the present invention.

Another magnetically actuated valve assembly 70 is shown in FIG. 6. FIG. 6 shows a cut-out, close-up side-view of a magnetically actuated valve assembly 70 with a ferromagnetic insert 36 as used in the present invention. A magnetically actuated valve assembly 70 of FIG. 6 can be used in place of the assemblies 32, 33 of FIGS. 1–5. An engine including the valve assembly 70 of FIG. 6 operates in the same manner as described above in describing FIGS. 1–4.

The assembly 70 shown in FIG. 6, referred to because convenient as an exhaust valve assembly, comprises a magnet 46, a spring 44, a non-magnetic exhaust valve 80 made of a high-wear non-conductive material, for example, ceramic, a magnetic insert 36 inserted into the exhaust valve 80, preferably inserted into the portion of the exhaust valve 80 nearest the magnet 46, and an exhaust valve cylinder 64. The insert may be made of cobalt or another material capable of being attracted to magnetic energy. Thus, instead of the entire valve being attracted by the magnet 46, the magnet attracts the magnetic insert 36, and the magnetic insert in turn forces the valve 80 against the spring 44 toward the magnet 46. Note that the valve portion 80 may be made of such material that insulates the port, intake/exhaust, and other structure from the electromagnetic field.

Figure 7:
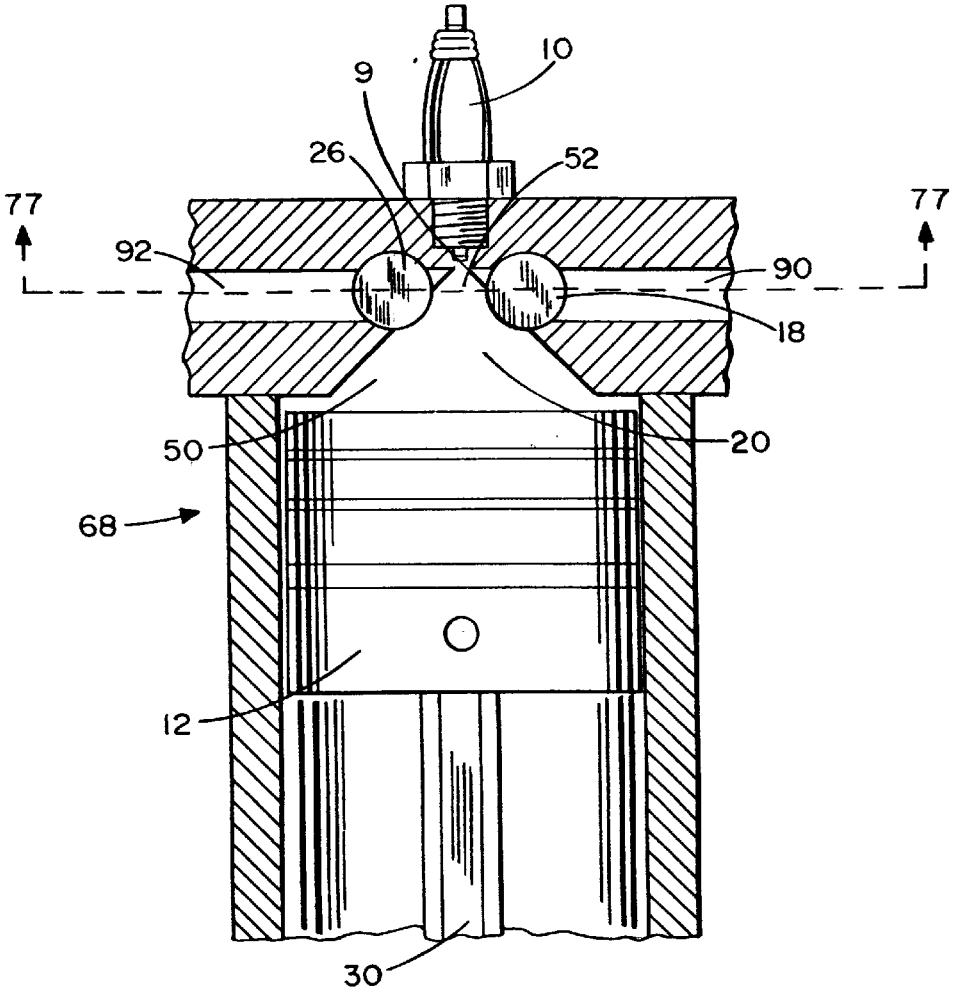
FIG. 7 shows a cut-out view of an engine with a spark plug placed at the top center of a cylinder with a cone-shaped combustion chamber, and fuel intake valve and exhaust valves placed on the upper side of said cylinder, wherein a fuel intake port is connected to a fuel intake valve and an exhaust port is connected to the exhaust valve, and the two ports are aligned.

FIG. 7 shows the cylinder head portion 68 and surrounding structure of another embodiment of the present invention. The cylinder 20 has a spark plug 10 placed at the top center of the cylinder 20 with a cone-shaped combustion chamber 50. The fuel intake valve 18 and exhaust valve 26 (shown in side view) are placed on the upper side of the cylinder 20. The valves reciprocate within the valve cylinder perpendicular to the cylinder head 12. The fuel intake port 90 is connected to a fuel intake valve 18 (shown in side view). An exhaust port 92 is connected to the exhaust valve 26. The fuel intake port 90 and the exhaust port 92 are aligned. The valves 18, 26, operate like the valves of the embodiments described above. That is, the embodiment shown in FIG. 7 operates in a four-stroke engine just like the corresponding parts of the above embodiments. The cylinder head portion 68 shown in FIG. 7 is substituted for those parts in operation. The valves 18, 26 shown in FIG. 7 operate as magnetically actuated valves just as the valves 18, 26 of embodiments described above. An engine using the cylinder head portion 68 shown in FIG. 7 can be designed in a stream-lined manner and compact manner, allowing for a greater degree of design freedom.

Figure 20:
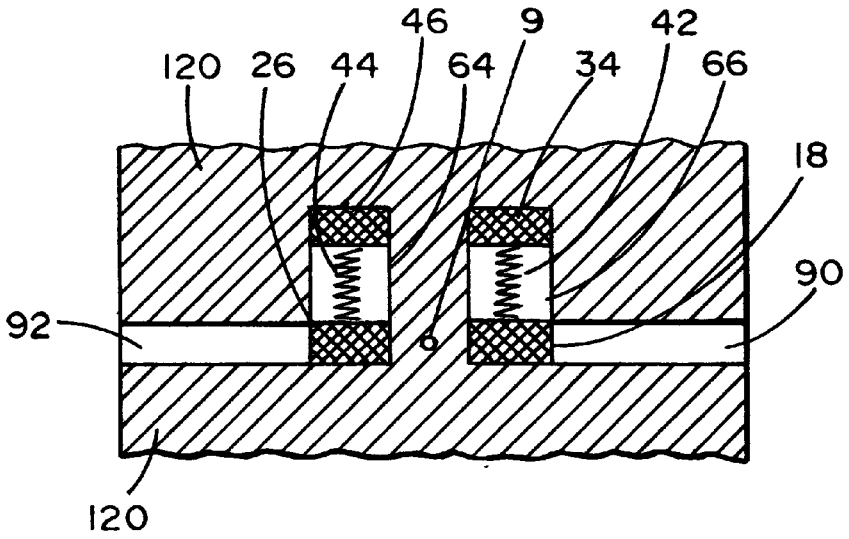
FIG. 20 shows a cut-out view of the engine shown in FIG. 7 along the line 77—77.

FIG. 20 shows a cut-out view of the embodiment shown in FIG. 7 along the line 77—77. As described above, upon actuation of the exhaust valve electromagnet 46, the exhaust valve 26 moves towards the electromagnet 46 within the exhaust valve guide 64, compresses the spring 44, moves substantially outside of the exhaust port 92, thus unblocking the path between the port 92 and the cylinder 20. Likewise, as described above, upon actuation of the intake valve electromagnet 34, the intake valve 18 moves towards the electromagnet 34 within the intake valve guide 66, compresses the spring 42, moves substantially outside the intake port 90, thus unblocking the path between the port 90 and the cylinder 20. The tip of the spark plug 9 is also shown. Note that the movement of the valves are perpendicular to the movement of the cylinder head 12 in this embodiment. The invention contemplates movement of the valves at any angle relative to the cylinder head and any angle at which the valve guide is constructed relative to the cylinder head.

Figure 21:
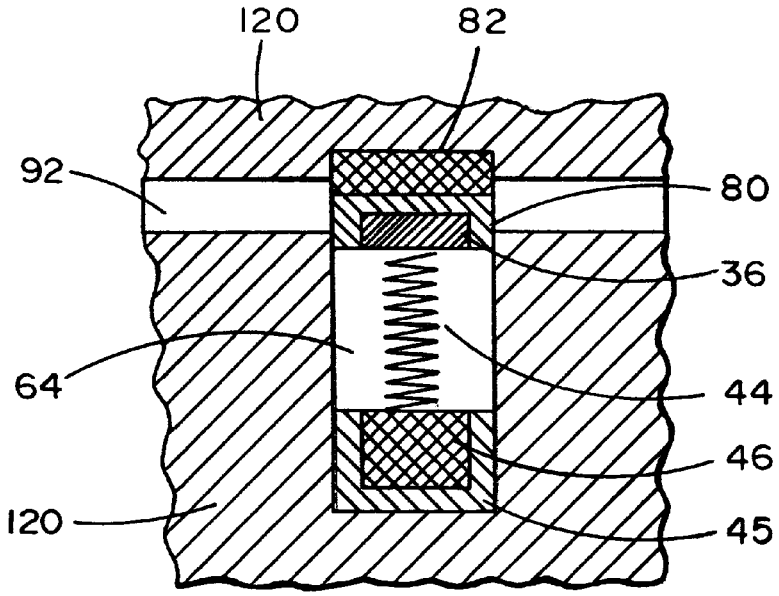
FIG. 21 shows a sectional view showing a bumper, valve (with insert), spring, and magnet in a valve cylinder, the surrounding engine block in a cut-out view, and a port used in the present invention, wherein the port is closed.
Figure 22:
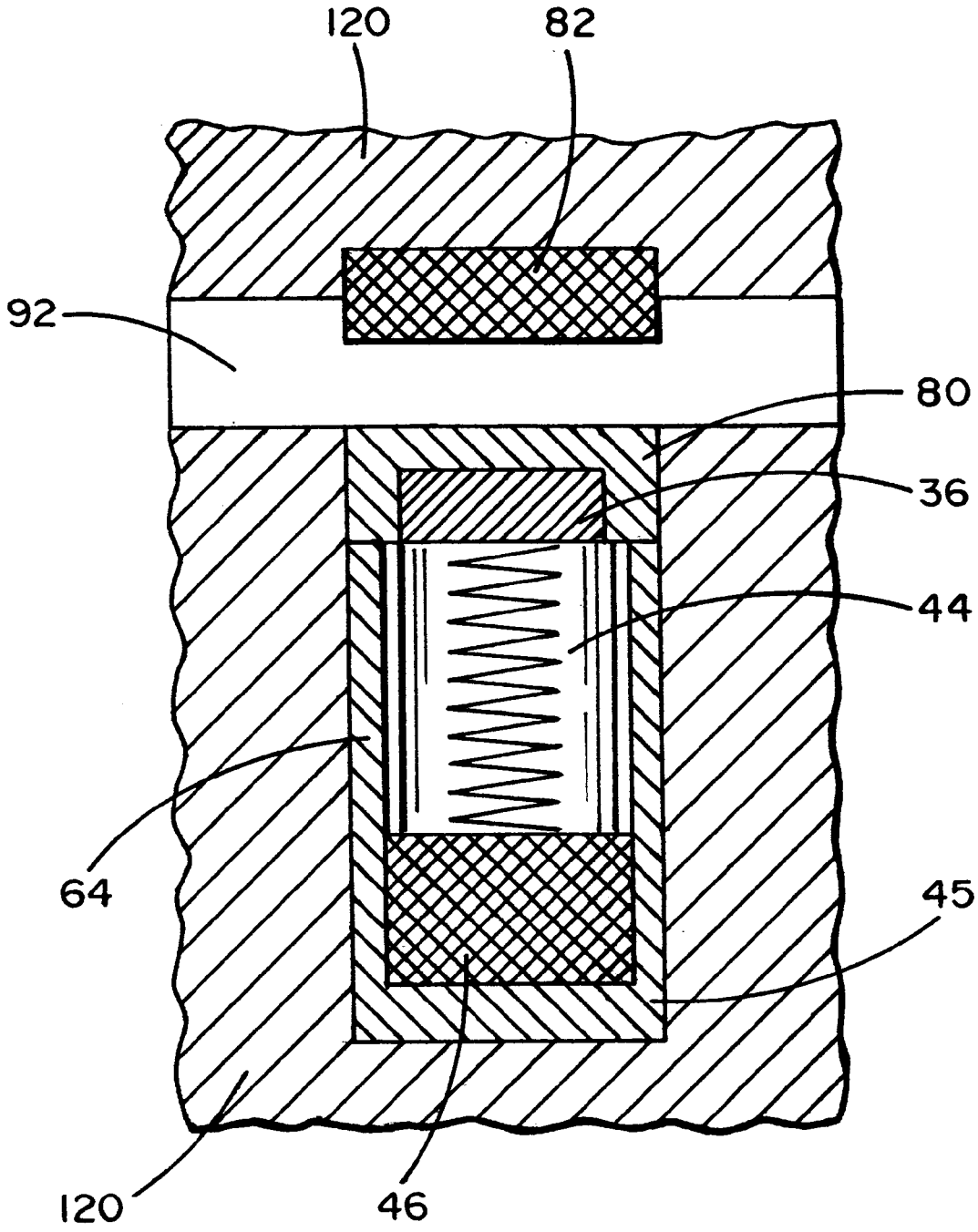
FIG. 22 shows a sectional view showing a bumper, valve (with insert), spring, and magnet in a valve cylinder, the surrounding engine block in a cut-out view, and a port used in the present invention, wherein the port is open.

FIGS. 21 and 22 show another embodiment of the present invention. FIG. 21 shows an exhaust valve assembly and surrounding structure. Like the valve portion shown in FIG.

6, the valve portion of the assembly includes a non-magnetic exhaust valve 80 with a magnetic insert 36. The non-magnetic element is not attracted to electromagnetic force from the magnet 46, but the magnetic insert 36 is attracted to said force. The electromagnet 46 is housed in a magnet insulator 45, which serves to insulate the surrounding engine block 120 from the magnetic field from the electromagnet 46. FIG. 21 also shows a bumper 82 of the present invention. The bumper 82 shown is stationary, and is coupled to the engine block 120 above the mouth of the valve guide, and partially blocks the port 92. Bumpers located in a different place and configuration, and bumpers that do not partially block the port 92, may also be used. The bumper 82 cushions the valve when the valve closes the port 92. The bumper 82 may be made of a variety of materials, including Teflon or steel. FIG. 21 shows the valve 80 resting against the bumper 82, thereby blocking the port 92, when the electromagnet is not actuated. When the electromagnet is actuated, the valve 80 and insert 36 move within the valve guide towards the magnet 46, thereby compressing the spring 44. In this embodiment, the valve 80 moves towards the magnet 46 until it is stopped by the upper edges of the insulator 45 as shown.

FIG. 23 shows one embodiment of a removable valve assembly 130, including a valve 132, a spring 134, an electromagnet 136, a valve guide comprised of a magnetic-field shield 138, and conductors 140, 142. In this embodiment, the shield 138 serves as a housing for the assembly 130. The removable assembly 130 is constructed to fit within a cut-out portion 152 of the engine block 120 coupled to a port 90. The conductors 140, 142 rest within two receptacles 144, 146 which serve to connect the conductors 140, 142 to wires 148, 150 which may be tapped on the cylinder head. The wires 148, 150 are connected to a power source (not shown) controlled by a computer (not shown). The wires 148, 150, receptacles 144, 146, and conductors 140, 142 are used to provide power to the electromagnet 136.

Figure 24:
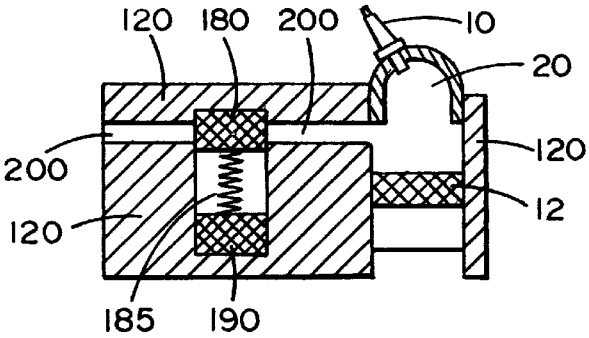
FIG. 24 shows a sectional view of an engine according to the present invention having a single port, valve, and electromagnet for exhaust and intake.

The embodiments shown in the figures discussed above have two ports, an exhaust port and an intake port. Engines of the present invention may have just one port, that serves as both an intake and an exhaust port, or that serves as just an intake port, or otherwise, or may have two, three, four, or more ports, as desired and needed for a particular application. FIG. 24 shows a cut-out view of part of an engine according to the present invention. Port 200 serves as both an intake and exhaust port. Valve 180 serves to block intake from entering the combustion chamber 20 during the appropriate times, serves to keep intake from escaping the chamber 20 during the appropriate times, and serves to block exhaust from exiting the combustion chamber 20 during the appropriate time, for example, during compression when the valve 180 blocks the port 200. Likewise, the valve 180 moves towards the magnet 190 into the valve guide at the appropriate times to allow intake to enter the chamber and exhaust to exit the chamber at the appropriate times.

The embodiment shown in FIGS. 1–4 is in the embodiment of a four-stroke engine. The engine of the present invention is equally effective, when embodied in a two-stroke engine or other types of engines. The valves, or valve assembly, of the present invention replace the standard valves, or valve assembly, of those engines in the same manner as described above for a four-stroke engine. Those valves operate in a two-stroke engine and other engines in the same or similar manner as described above for a four-stroke engine.

Figure 26:
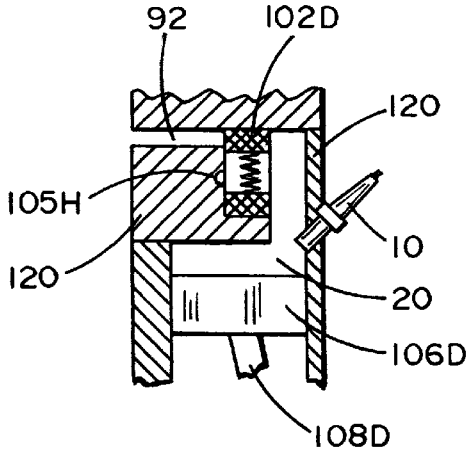
FIG. 26 shows a sectional view of the engine shown in FIG. 25.
Figure 25:
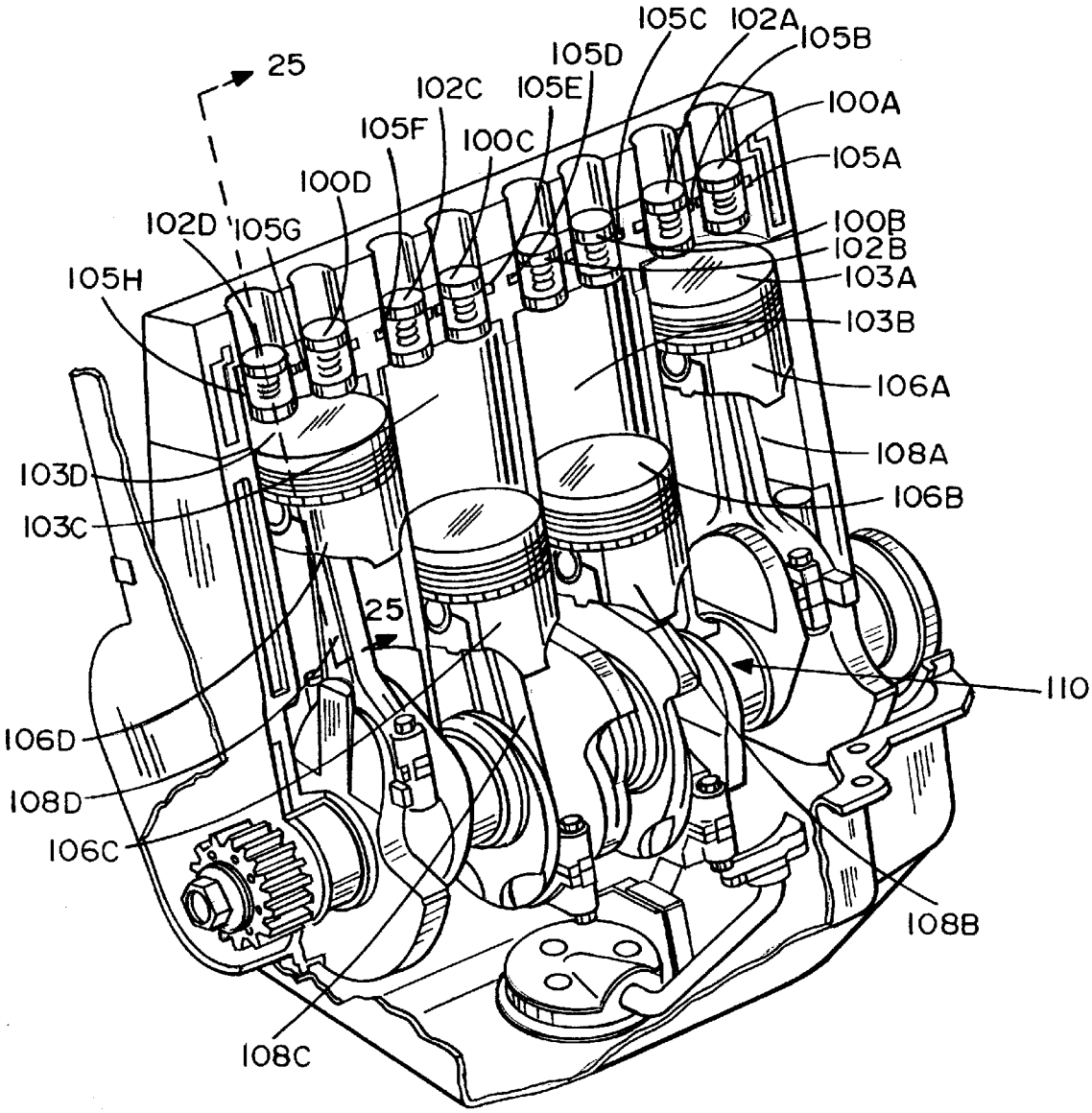
FIG. 25 shows an engine according to the present invention having four cylinders.

Of course, an engine may comprise more than one set, or some combination thereof, of elements of the present invention. For example, in a 4-cylinder engine, popular for use in automobiles, an engine might employ 4 cylinders, 4 spark plugs, 4 pistons, 4 crankshafts, 4 connecting rods, 4 fuel intake valves, and 4 exhaust valves. FIG. 25 shows a cut-out view of a portion of a 4-cylinder engine of the present invention with 4 cylinders, 4 spark plugs, 4 pistons, 4 crankshafts, 4 connecting rods, 4 fuel intake valves, and 4 exhaust valves. In FIG. 25, four fuel intake valves 100A–D and four exhaust valves 102A are positioned above four cylinders 103A–D containing four pistons 106A–D. The pistons 106A–D are connected to four connecting rods 108A–D, which are in turn connected to a crankshaft 110. As described above, in the embodiment shown in FIG. 25, a electromagnetic means is used to operate the valves, instead of the rocker arm means used in prior art engines. The operation of a four-cylinder engine is well known. In the present invention, each of valves 100A–D, 102A–D are operated in the same manner as the valves described above in a single-cylinder environment. In the embodiment shown in FIG. 25, each valve 100A–D, 102A–D is associated with an electromagnet 105A–H. Each partially encircles the valve guide with which it is associated. An electromagnet, e.g., 105C, actuates the movement of a valve, e.g., fuel intake valve 100B, in the same manner as described above, allowing fuel to enter the cylinder or exhaust to exit the cylinder. A cut-out side view along the line 25—25 is shown in FIG. 26, showing further detail of this embodiment. As can be seen, the exhaust port 92 is coupled to a combustion chamber 20. The valve 102D serves to block the port, thereby keeping the port closed, during the appropriate phases of engine operation (described above). When exhaust is to be removed from the chamber 20, the electromagnets 105H and 105G actuate, emitting an electromagnetic field and forcing the valve against the spring, towards the engine block 120 below, thereby forcing the valve 102D into the valve guide and at least partially outside of the port 92, allowing exhaust to exit the chamber 20.

FIG. 26 shows a sectional side view of the engine shown in FIG. 25. The coupling between the port 92 and the cylinder 20 can be seen more clearly. Each of the valves 100A–D, 102A–D is associated with like structure.

Methods such as boring, die-casting, molding, and other techniques used in engine construction can be used to construct engines according to the present invention. Such engines may be used in a wide variety of applications, including automobiles and other vehicles, lawn mowers, heavy equipment, generators, tools, and other applications that may employ engines.

Figure 27:
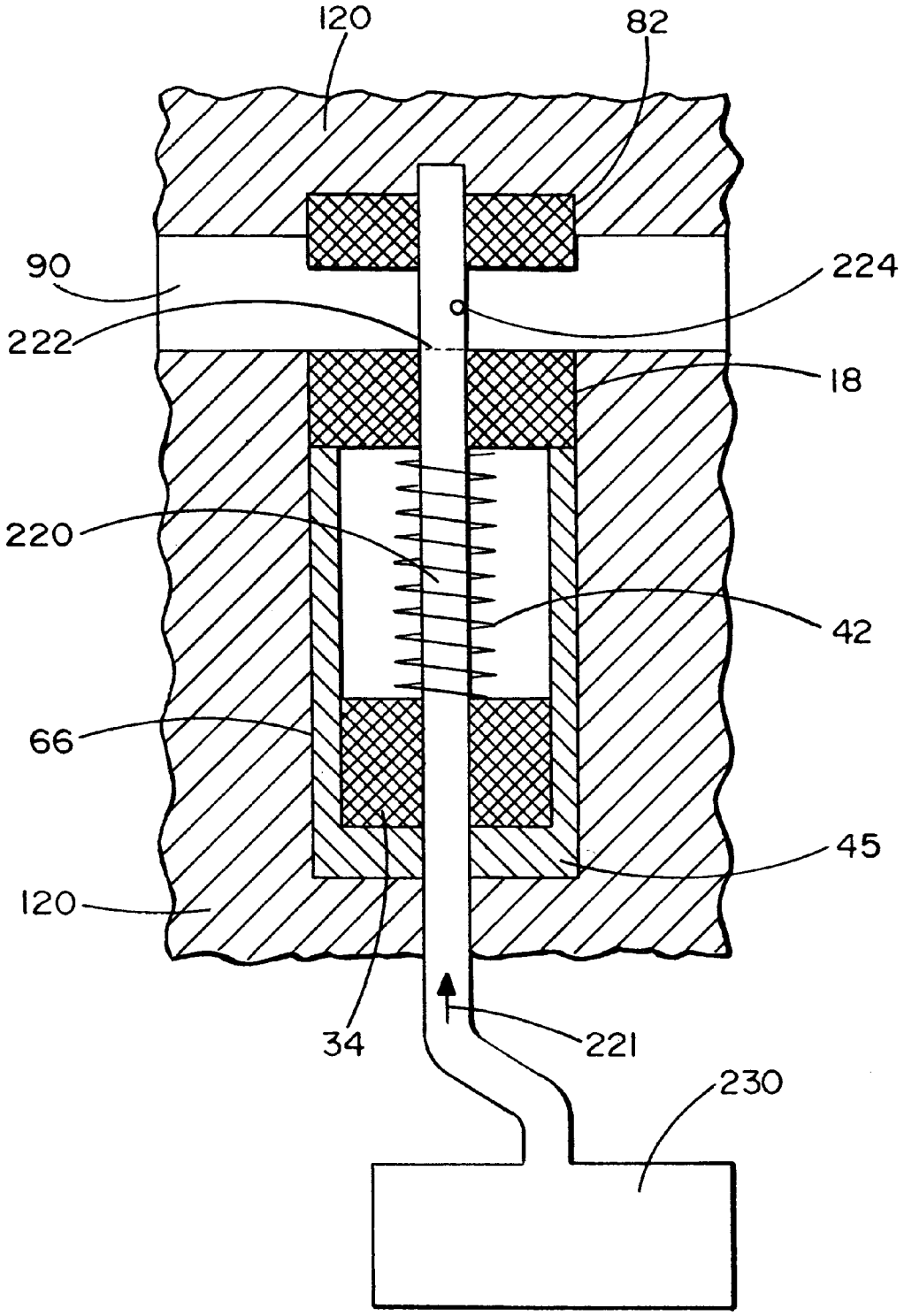
FIG. 27 shows a sectional view showing a bumper, valve, spring, magnet and fuel-dispensing tube in a valve cylinder, the surrounding engine block in a cut-out view, a fuel pump system, and a port used in the present invention, wherein the port is open.

FIGS. 27–31 show another embodiment of the present invention. In this embodiment, a fuel-dispensing tube 220 transports fuel from a fuel pump system 230 to the intake port 90. The fuel-dispensing tube 220 shown is hollow and may be made of a variety of materials, including stainless steel or ceramic materials. The fuel-dispensing tube 220 may also be coated with Teflon. The fuel-dispensing tube 220 is stationary, and is coupled to the engine block 120 above the mouth of the valve guide. The fuel-dispensing tube 220 may alternatively terminate in a bumper 82, as shown in FIG. 27, or at some other point between the mouth of valve guide and the engine block 120. The tube may be any desired shape.

The fuel-dispensing tube 220 comprises at least one aperture 224 opening to the intake port 90. The number of apertures, the location of the apertures on the fuel-dispensing tube 220, and the size of the apertures 224 may be varied so long as a sufficient amount of fuel is delivered to the cylinder 20 for operation of the engine 14. The amount of fuel delivered to the cylinder 20 may be controlled by the size, location and number of apertures 224, and the frequency of the valve movement. Manipulation of these variables allows control of frequency, amount, and duty cycle of fuel flow. A preferred embodiment utilizes two apertures 224, each positioned on the hollow tube 220 such that fuel is dispensed in substantially the same direction as air entering the port 90.

Various types of fuel delivery systems 230 are well known within the art and a person of ordinary skill in the art may select a fuel delivery system 230 appropriate for the operation of the present invention, such as a fuel pump system 230. The fuel pump system 230 is capable of supplying fuel under pressure.

FIG. 27 shows an intake valve assembly and surrounding structure, wherein the port 90 is open. A fuel-dispensing tube 220 is connected to a fuel pump system 230, and transports fuel through the intake valve assembly to the intake port 90. The system 230 places fuel under pressure causing fuel to flow through the tube 220 in the direction shown by the arrow 221. Certain features of the intake valve assembly shown in FIG. 27 accommodate the fuel-dispensing tube 220. The magnet insulator 45 and the magnet 34 each have an opening to enable the fuel-dispensing tube 220 to pass through them and to continue through the center of the spring 42.

The fuel intake valve 18 has an opening to enable the fuel-dispensing tube 220 to pass through it. The area between the outer wall of the fuel-dispensing tube 220 and the inner wall of the fuel intake valve 18 should be sealed, for example, with a gasket 222 (shown as dotted lines) to prevent fuel from entering the interior of the valve assembly. Drainage structure, sealing structure, or other similar devices could also be used to combat seepage of fuel into the valve assembly. The fuel intake valve 18 is able to efficiently slide over the fuel-dispensing tube 220. This may be facilitated, for example, by coating the fuel-dispensing tube 220 with Teflon or similar dry film coating. The fuel intake valve 18 may be made of any material attracted to electromagnetic force, such as steel or cobalt, as discussed above. The fuel intake valve 18 may also comprise a non-magnetic exhaust valve with a magnetic insert, as discussed above.

Figure 32:
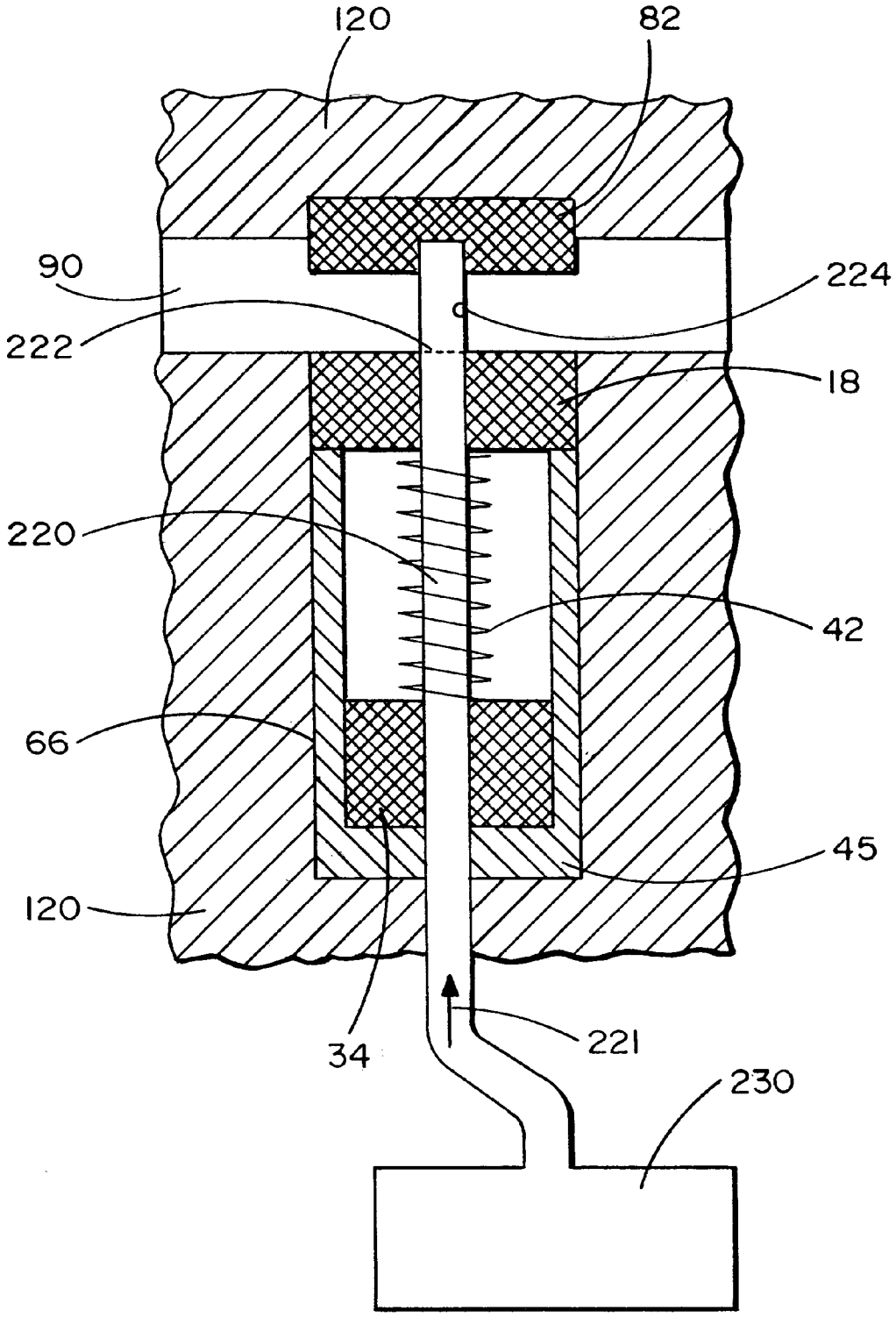
FIG. 32 shows a sectional view showing a bumper, valve, spring, magnet and fuel-dispensing tube in a valve cylinder, the surrounding engine block in a cut-out view, a fuel pump system, and a port used in the present invention, wherein the port is open and wherein the fuel-dispensing tube terminates in the bumper and does not enter the engine block itself.
Figure 33:
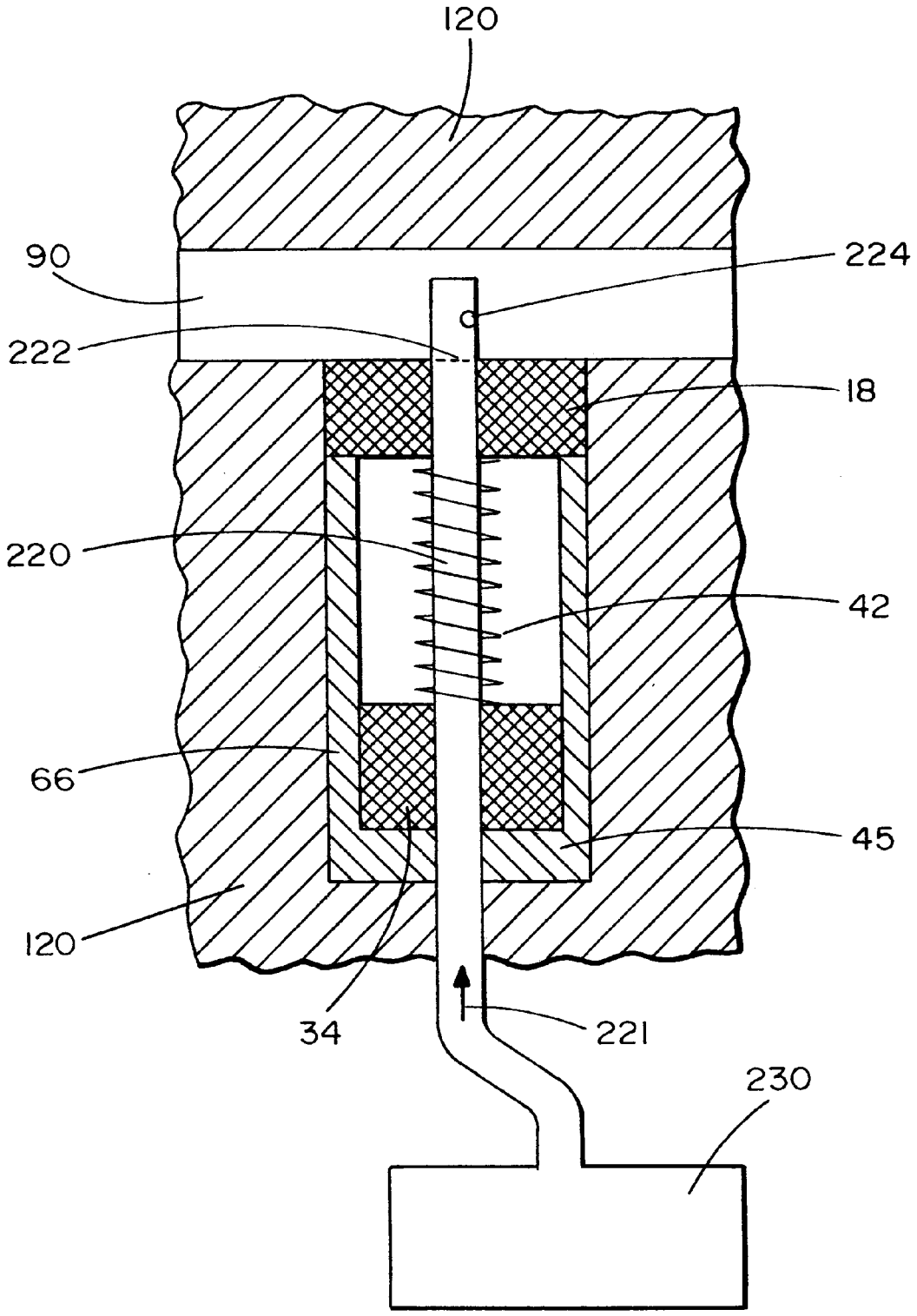
FIG. 33 shows a sectional view showing a valve, spring, magnet and fuel-dispensing tube in a valve cylinder, the surrounding engine block in a cut-out view, a fuel pump system, and a port used in the present invention, wherein the port is open and wherein the fuel-dispensing tube terminates at a point between the mouth of the valve guide and the engine block.

FIG. 27 shows an embodiment of the present invention utilizing a bumper 82. In one alternative, when a bumper 82 is utilized, the bumper 82 has an opening to enable the fuel-dispensing tube 220 to pass through it and to terminate in the engine block 120. The fuel-dispensing tube 220 may alternatively (and preferably) terminate in the bumper 82 without entering the engine block. Such arrangements provide structural stability to the tube 220, but is not necessary to the operation of the invention. FIG. 32 shows an embodiment of the present invention with a bumper 82, and with a tube that terminates in bumper 82 and does not enter the engine block 120 itself. The tube 220 may terminate at some other point between the mouth of the valve guide (i.e., the top portion of the valve, or the portion that is exposed to the port) and the engine block 120. For example, FIG. 33 shows an embodiment of the present invention with no bumper, and in which the tube terminates in the port 90.

In FIG. 27, the magnet 34 has emitted an electromagnetic field causing the fuel intake valve 18 to move toward the magnet 34 against the fuel-valve biasing spring 42 that the valve 18 is biased against, consequently compressing the biasing spring 42. The aperture 224 in the fuel-dispensing tube 220 is revealed and fuel from the fuel pump system 230 is released into the port 90 where it mixes with incoming air to form a combustible material, which is transported to the cylinder 20. The tube 220 holds fuel under pressure supplied by the fuel pump system 230. The fuel within the tube 220 is under pressure. When the valve 18 has not been actuated, the valve 18 covers and blocks the aperture 224, thus preventing fuel from escaping the tube 220 through the aperture 224. When the movement of the valve 18 reveals the aperture 224, thereby unblocking the aperture 224, the fuel, under pressure, flows through the aperture 224.

The frequency of the fuel spray may be varied by varying the frequency of valve movement. The duty cycle of the fuel spray can be varied by varying the duty cycle of the valve movement, and the pulse duty cycle of the spray may be varied by varying the placement (height) of the aperture along the tube 220.

Figure 28:
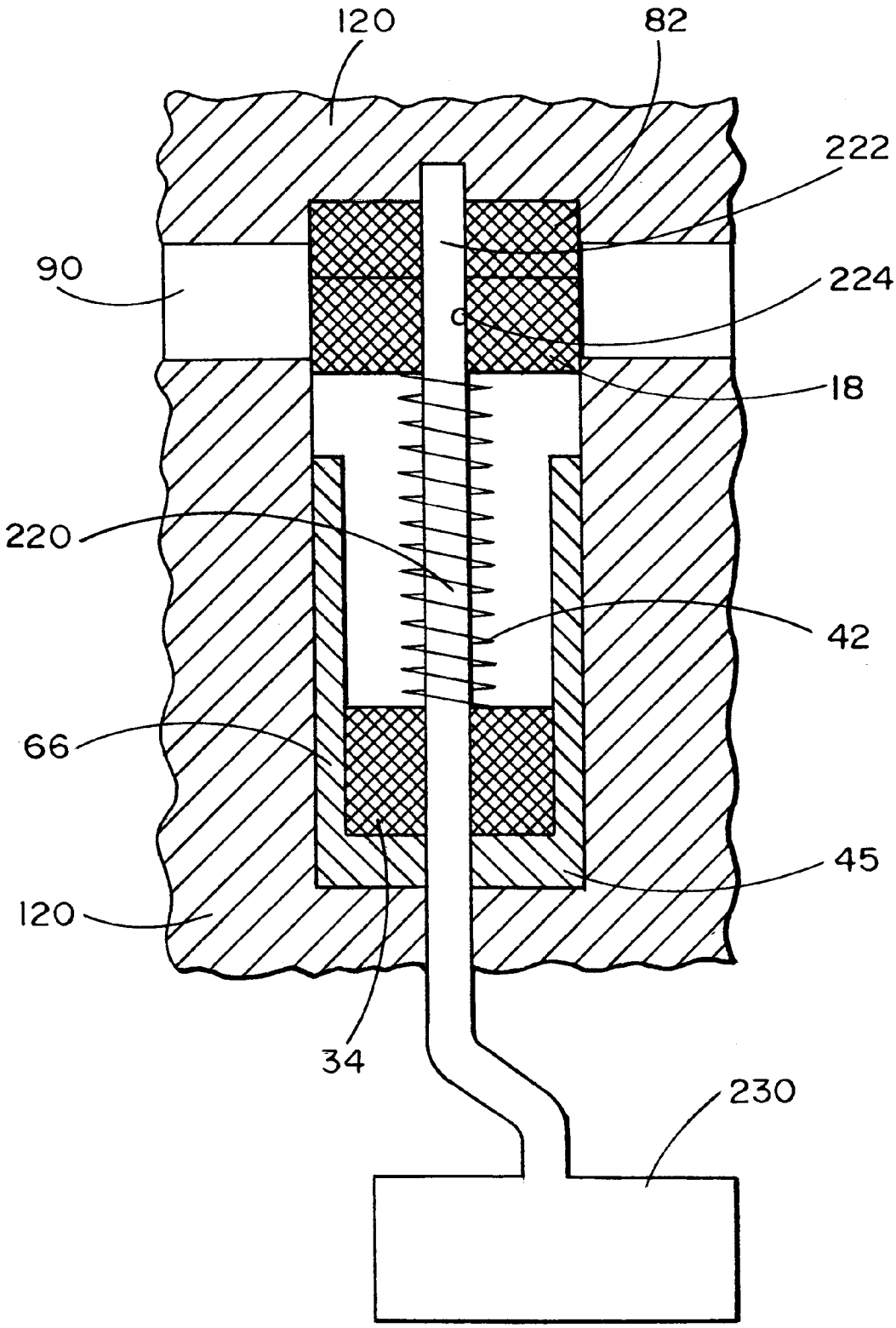
FIG. 28 shows a sectional view showing a bumper, valve, spring, magnet and fuel-dispensing tube in a valve cylinder, the surrounding engine block in a cut-out view, a fuel pump system, and a port used in the present invention, wherein the port is closed.

FIG. 28 shows an intake valve assembly and surrounding structure, wherein the port 90 is closed. The magnet 34 has ceased emitting an electromagnetic field. Consequently, the force of the fuel intake valve 18 no longer compresses the fuel-valve biasing spring 42, and the spring 42 forces the fuel intake valve 18 to move within the valve guide back into the intake port 90 to its normally closed position. The aperture 224 in the fuel-dispensing tube 220 is covered by the fuel intake valve 18, such that fuel is no longer released into the intake port 90. In this position, the valve 18 also blocks any entry of air into the cylinder 20 through the port 90.

Figure 29:
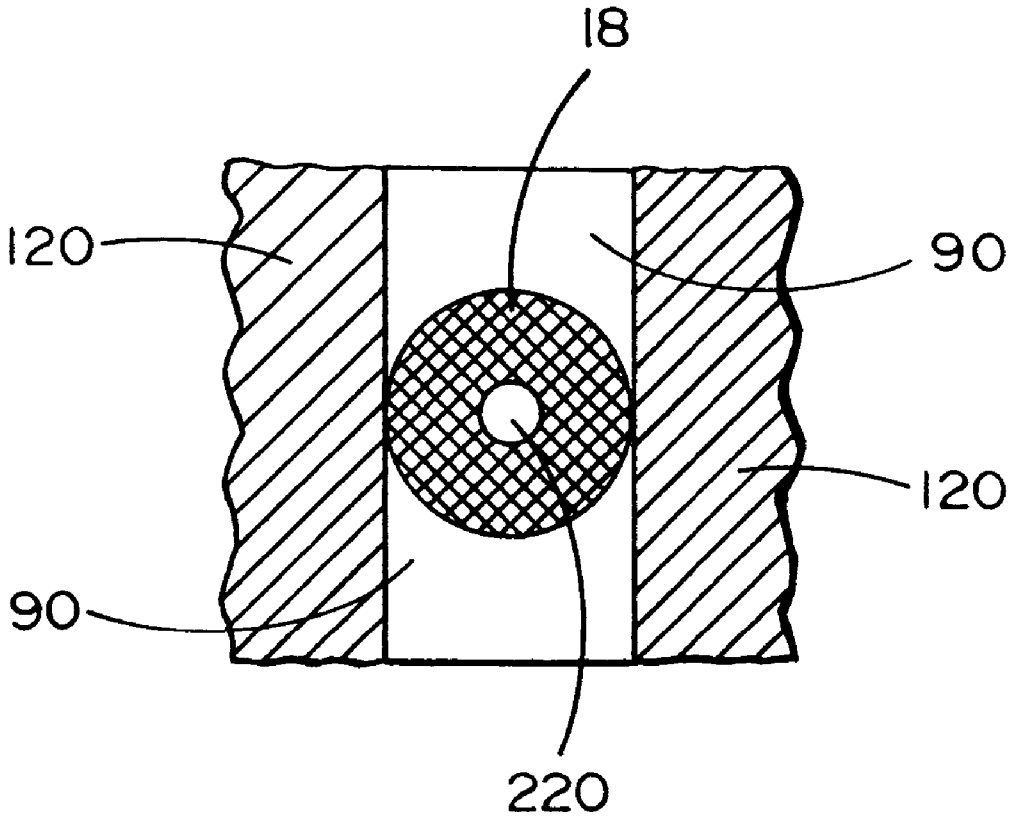
FIG. 29 shows a top cut-out view of an engine according to the present invention, showing a port, a valve, a fuel-dispensing tube, and the surrounding engine block.

FIG. 29 shows a top cut-out view of a fuel intake valve 18 in an intake port 90. The fuel-dispensing tube 220 is shown in the center of the fuel intake valve 18. Although the fuel-dispensing tube 220 is shown as cylindrical in FIG. 29, any convenient shape may be utilized. As noted earlier and as shown in FIGS. 16–19, the fuel intake valve 18 may be coupled to the port 90 in a number of configurations and may also be any convenient shape.

Figure 30:
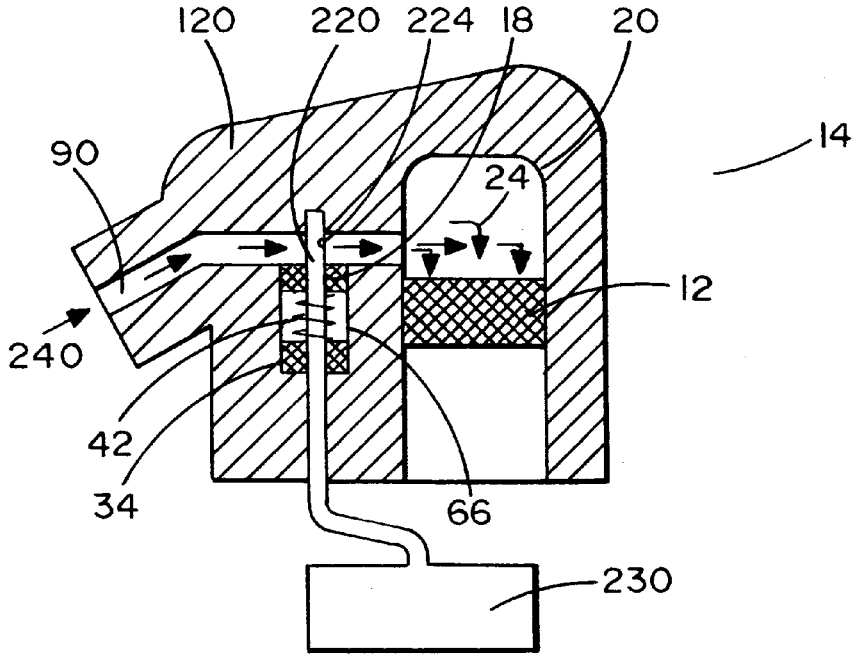
FIG. 30 shows a cut-out view of the engine shown in FIGS. 1–4 along the line 11—11 in the intake stroke, showing the intake valve assembly utilizing a fuel-dispensing tube in the valve cylinder, intake port, and the gap in the intake port during the intake phase shown in FIG. 1.

FIG. 30 shows a cut-out side view of another embodiment of the engine shown in FIGS. 1–4 along the line 11—11 in the intake stroke with a fuel-dispensing tube 220. The fuel intake valve 18 is open, revealing the aperture 224 in the fuel-dispensing tube 220. Fuel from the fuel pump system 230 exits the fuel-dispensing tube 220 through the apertures 224 and enters the intake port 90. The fuel mixes with incoming air 240 to form a combustible material 24 and is drawn into the cylinder 20.

Figure 31:
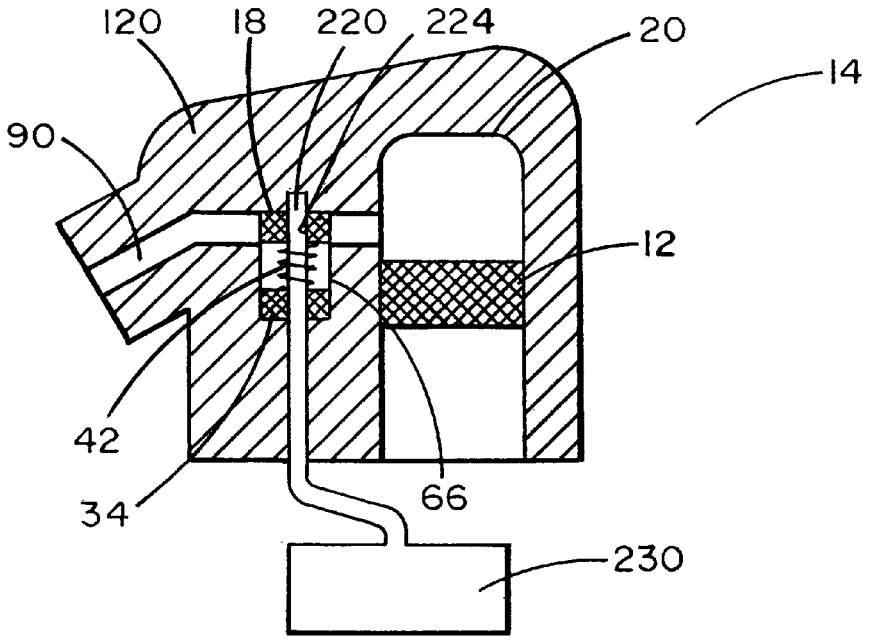
FIG. 31 shows a cut-out view of the engine shown in FIG. 30 in the compression stroke, showing the intake valve assembly, utilizing a fuel-dispensing tube in the valve cylinder, and intake port during the compression phase.

FIG. 31 shows a cut-out side view of the engine shown in FIG. 30 in the compression stroke. The fuel intake valve 18 is closed, covering the apertures 224 in the fuel-dispensing tube 220. Fuel from the fuel pump system 230 is thereby prevented from entering the intake port by the fuel intake valve 18. The fuel intake valve 18 also blocks the intake port 90 when it is closed. The closing of the valve 18 traps the fuel and air mixture 24 in the cylinder 20.

The tube 220 shown extends beyond the top of the port 90, but extension of the tube so far into the port 90, and consequent obstruction of the port 90, is not necessary. In one embodiment, the tube 220 and aperture 224 may extend only slightly above the valve 18 when the valve 18 is moved to its furthest position closest to the magnet 34. Indeed, in one embodiment, the tube 220 may not extend above the valve 18 in such position. Instead, the aperture may be placed at the end (i.e., the top) of the tube, and be opened upon movement of the valve 18 to such position.

Preferably, the tube 220 is no longer hollow, or is blocked, just slightly above the placement of the aperture 224. This blocking prevents fuel from moving within the tube into an area above the aperture. Such blocking prevents dripping, and lessens the pressure necessary to provide fuel to and through the aperture.

The foregoing is provided for purposes of explanation and disclosure of a preferred embodiment of the present invention. Modifications of and adaptations to the described embodiment will be apparent to those of ordinary skill in the art of the present invention and may be made without departing from the scope or spirit of the invention and the following claims.

I claim:

1. A fuel-dispensing system comprising:

an intake port for delivering air:

a tube positioned at least partially within the intake port, the tube having a wall with at least one aperture for delivering fuel to the intake port; and a valve capable of blocking the at least one aperture;

wherein the valve is capable of movement within the intake port such that the at least one aperture is at least partially unblocked, and wherein the valve is capable of blocking the intake port to prevent the delivery of air.

2. A fuel-dispensing system comprising:

an intake port for delivering air;

a tube positioned at least partially within the intake port, the tube having a wall with at least one aperture for delivering fuel to the intake port; and a valve capable of blocking the at least one aperture;

wherein the valve is capable of movement within the intake port such that the at least one aperture is at least partially unblocked, and wherein the valve is capable of moving between a closed position where the intake port and the at least one aperture are blocked by the valve, and an open position where the intake port and the at least one aperture are at least partially unblocked by the valve.

3. A fuel dispensing system comprising:

a combustion chamber;

an intake port for delivering air, the intake port being connected to the combustion chamber;

a fuel delivery system;

a tube connecting the fuel delivery system to the intake port, the tube positioned at least partially within the intake port, and the tube having a wall with at least one aperture for delivering fuel to the intake port; and a valve sealingly engageable with the at least one aperture to block the delivery of fuel to the intake port;

wherein the valve is capable of moving between at least a first position where the intake port and the at least one aperture are blocked by the valve and a second position where the intake port and the at least one aperture are at least partially unblocked by the valve.

4. A fuel dispensing system comprising:

a combustion chamber:

an intake port for delivering air, the intake port being connected to the combustion chamber;

a fuel delivery system;

a tube connecting the fuel delivery system to the intake port, the tube positioned at least partially within the intake port, and the tube having a wall with at least one aperture for delivering fuel to the intake port;

a valve sealingly engageable with the at least one aperture to block the delivery of fuel to the intake port; and a valve guide connected to the intake port, wherein the valve moves within the valve guide between a first, closed position where no fuel is allowed to flow into the intake port through the at least one aperture and no air is allowed to flow through the intake port and a second, open position where fuel is allowed to flow into the intake port through the at least one aperture and air is allowed to flow through the intake port.

5. A fuel dispensing system comprising:

a combustion chamber;

an intake port for delivering air, the intake port being connected to the combustion chamber;

a fuel delivery system;

a tube connecting the fuel delivery system to the intake port, the tube positioned at least partially within the intake port, and the tube having a wall with at least one aperture for delivering fuel to the intake port;

a valve sealingly engageable with the at least one aperture to block the delivery of fuel to the intake port; and a bumper, wherein the tube extends completely through the intake port into the bumper to provide structural stability to the tube, and wherein the bumper blocks the end of the tube so as to allow fuel to pass only through the at least one aperture into the intake port.

6. A fuel dispensing system comprising:

a combustion chamber;

an intake port for delivering air, the intake port being connected to the combustion chamber;

a fuel delivery system;

a tube connecting the fuel delivery system to the intake port, the tube positioned at least partially within the intake port, and the tube having a wall with at least one aperture for delivering fuel to the intake port; and a valve sealingly engageable with the at least one aperture to block the delivery of fuel to the intake port;

wherein the tube extends completely through the intake port into a cylinder head to provide structural stability to the tube, and wherein the cylinder head blocks the end of the tube so as to allow fuel to pass only through the at least one aperture into the intake port.

7. A fuel delivering system comprising:

a combustion chamber;

an intake port connected to the combustion chamber;

a fuel delivers tube positioned at least partially within the intake port, wherein the fuel delivery tube has a wall with at least one aperture; and a valve moveable within the intake port and in sliding communication with the fuel delivery tube between a first position that sealingly engages the at least one aperture to block the flow of fuel and a second position that uncovers the at least one aperture to allow fuel to flow through the at least one aperture into the intake port;

wherein the intake port comprises walls, and wherein, in the first position, the valve sealingly engages the walls of the intake port to prevent air from flowing into the combustion chamber.

8. The fuel delivering system of claim 7, wherein, in the second position, the valve at least partially disengages the walls of the intake port, allowing air to flow through the intake port into the combustion chamber.

* * * * *